US007261391B2

(12) United States Patent
Van Gerven

(10) Patent No.: US 7,261,391 B2
(45) Date of Patent: Aug. 28, 2007

(54) NOZZLE CLEANING DEVICE FOR AN INK JET PRINTER

(75) Inventor: Antonius J. J. Van Gerven, Grubbenvorst (NL)

(73) Assignee: OCE-Technologies B.V., Venlo (NL)

( * ) Notice: Subject to any disclaimer, the term of this patent is extended or adjusted under 35 U.S.C. 154(b) by 320 days.

(21) Appl. No.: 11/033,114

(22) Filed: Jan. 12, 2005

(65) Prior Publication Data

US 2005/0285893 A1 Dec. 29, 2005

(30) Foreign Application Priority Data

Jan. 14, 2004 (EP) ..... 04075043

(51) Int. Cl.
*B41J 2/165* (2006.01)

(52) U.S. Cl. ..... 347/22

(58) Field of Classification Search ..... 347/22, 347/23, 29, 35; 251/149.1; 417/415
See application file for complete search history.

(56) References Cited

U.S. PATENT DOCUMENTS 4,558,326 A 12/1985 Kimura et al.
4,870,431 A 9/1989 Sousa et al.
5,659,347 A 8/1997 Taylor
6,095,633 A 8/2000 Harshbarger et al.

FOREIGN PATENT DOCUMENTS

EP 0 578 334 A2 1/1994
EP 0 615 846 A1 9/1994
WO WO-03/053700 A1 7/2003

*Primary Examiner*—Shih-Wen Hsieh
(74) *Attorney, Agent, or Firm*—Birch, Stewart, Kolasch & Birch, LLP

(57) ABSTRACT

A nozzle cleaning device for an ink jet printer containing a plurality of ink reservoirs, the cleaning device including a pressure source and a valve mechanism for selectively coupling the pressure source to the ink reservoirs, wherein the valve mechanism comprises a valve housing, and a piston movable within the valve housing and defining therewith a first pressure chamber and a second pressure chamber, said first and second pressure chamber being connected to the pressure source such that during idle conditions, the pressure source is in communication with the ink reservoirs through said first pressure chamber, and during cleaning conditions and through the movement of the piston, the pressure source is in selective communication with individual ink reservoirs through said second pressure chamber.

13 Claims, 1 Drawing Sheet

NOZZLE CLEANING DEVICE FOR AN INK JET PRINTER

This non-provisional application claims priority under 35 U.S.C. § 119(a) on Patent Application No. 04075043.2 filed in The European Patent Office on Jan. 14, 2004, which is herein incorporated by reference.

BACKGROUND OF THE INVENTION

The present invention relates to a nozzle cleaning device for an ink jet printer having a plurality of ink reservoirs, the cleaning device including a pressure source and a valve mechanism for selectively coupling the pressure source to the ink reservoirs.

An ink jet printer typically contains a plurality of printheads, e.g. at least one for each color in the case of a multi-color printer. Each printhead has an array of nozzles through which ink droplets can be jetted out onto a recording medium, and also ink reservoirs that are in communication with each of the nozzles of the nozzle array through respective ink channels. In or adjacent to each of the ink channels an actuator, e.g. a piezoelectric actuator is provided which may be energized in order to generate a pressure wave in the liquid ink in the ink channel, so that an ink droplet is expelled from the associated nozzle.

In some known ink jet printing systems, the ink reservoir is maintained under a slight subatmospheric pressure in order to prevent ink from leaking out of the nozzles.

Since the minute nozzles tend to become clogged with impurities, it is necessary to clean the nozzles from time to time. This is normally achieved by moving the printhead to a cleaning station and then applying a positive pressure to the ink reservoir in order to flush the nozzles with ink from the ink reservoir. The cleaning station includes a gutter which faces the nozzles of the printhead for collecting the ink that is ejected out of the nozzles in the flushing step, and may also include a wiper for removing remnants of ink and dust from the nozzle face of the printhead. Another purpose of such a cleaning or flushing procedure is to remove air bubbles that may have entered into the ink channels and which can have an adverse effect on the jetting properties of the nozzles.

In order to limit the required capacity of the pressure source and the dimensions of the cleaning station, it is preferable that the printheads are not cleaned simultaneously but are cleaned individually by applying pressure only to one ink reservoir at a time when the nozzles connected to this particular ink reservoir are in a position facing the ink collecting system of the cleaning station. This also has the advantage that the amount of waste ink can be reduced by performing the cleaning process only for the printhead or printheads that actually need a cleaning treatment. In this situation, however, a valve mechanism is required for connecting the pressure source selectively to the ink reservoir of the printhead that is being cleaned. Such a valve mechanism adds to the complexity and costs of the system as a whole, in particular since valves of the direct-driven type ought to be employed in view of the generally small differential pressures involved.

U.S. Pat. No. 6,095,633 discloses a cleaning device of the type described above, in which a separate valve is provided for each of the ink reservoirs in order to controllably connect the valves to a common pressure source.

U.S. Pat. No. 4,870,431 discloses a cleaning device for a hot-melt ink jet printer having a rotating printhead with nozzles arranged at the outer periphery thereof for printing onto a sheet of recording paper that has been wrapped around the printhead. Here, the interior of the printhead is subdivided into a plurality of ink reservoirs each having the cross-sectional shape of a sector of a circle. Each reservoir has a supply opening in its top face, so that solid pellets of ink may be dropped into the ink reservoir where the ink is molten. By rotating the printhead, each reservoir opening may be brought into a position where it is aligned with and sealingly connected to an air supply system. When the printhead is locked in this position, pressurized air is supplied into the ink reservoir for flushing the nozzles connected thereto. The rest of the top face of the printhead is covered by a stationary lid for closing off the openings of the ink reservoirs that are not in the cleaning position.

SUMMARY OF THE INVENTION

It is an object of the present invention to provide a nozzle cleaning device wherein the valve mechanism has a simple construction and can be manufactured and assembled at low costs.

According to the present invention, the nozzle cleaning device includes a valve housing having a wall with a plurality of outlet ports, each of which is connected to one of the ink reservoirs, and a piston movable in the valve housing and defining therewith a first pressure chamber and an inlet port connected to a pressure source and surrounded by a seal which defines, together with the wall of the valve housing a second pressure chamber adapted to be brought into communication with a selected one of the outlet ports through the movement of the piston.

The ink reservoirs may be constantly connected to the respective outlet ports of the valve housing, and a pressure suitable for flushing the nozzles connected to an individual ink reservoir may selectively be applied by moving the piston into a position in which the seal surrounds the outlet port to which that particular ink reservoir is connected. The seal will thus disconnect that outlet port from the first pressure chamber and will define the second pressure chamber that is connected to the pressure source through the inlet port of the piston, over an area of the wall of the valve housing which includes only the one outlet port.

The device according to the present invention is thus adaptable to a large variety of ink jet printers and permits a high degree of design choice as regards the arrangement of the printheads and the cleaning station and the manner in which the printheads are moved into and out of the cleaning station. The valve mechanism has a compact and simple construction with only a single movable member, i.e. the piston.

The first pressure chamber may be held at atmospheric pressure and will then only have the function to prevent foreign matter from entering through the outlet ports into the ink reservoirs. However, it is a particular advantage of the present invention that the first pressure chamber may be radially used for controlling the pressure inside of the ink reservoirs that are not being cleaned. Thus, for example, a single pressure control device is sufficient for maintaining the ink reservoirs of all printheads at a slight subatmospheric pressure in order to prevent the leakage of ink from the nozzles, unless the nozzles of a particular printhead are to be cleaned.

In the cleaning process, the piston may be moved steadily such that the seal passes sequentially over the outlet ports in the wall of the valve housing, so that pressure pulses of predetermined length are successively applied to the individual ink reservoirs.

In a particularly preferred embodiment, the movement of the piston in the valve housing may be coupled with the movement of the printheads relative to the cleaning station, so that the pressure pulses will be applied at appropriate timings, i.e. when the printheads are in the correct cleaning position. The coupling of the movement of the piston with the movement of the printheads may be achieved through mechanical means such as gears, rack-and-pinion devices and the like.

The movement of the piston in the valve housing may be a linear displacement, a rotation or a combination of both.

In a particularly preferred embodiment, the piston is moved linearly in a direction in parallel with the movement of a carriage carrying the printheads relative to the cleaning station. Then, the mechanical coupling may be achieved simply by elastically biasing the piston towards one end position and utilizing the relative movement between the carriage and the cleaning station for pushing the piston through the valve housing against the biasing force. To this end, the valve mechanism may be mounted on the carriage carrying the printheads, so that one end of the piston or a piston rod engages a stationary stop when the carriage reaches the cleaning position. As an alternative, the valve mechanism may be mounted to be stationary relative to the cleaning station, and an abutment on the carriage may be used for actuating the piston.

BRIEF DESCRIPTION OF THE DRAWINGS

A preferred embodiment of the present invention will now be described in conjunction with the accompanying drawings, wherein.

DETAILED DESCRIPTION OF THE INVENTION

Figure 1:
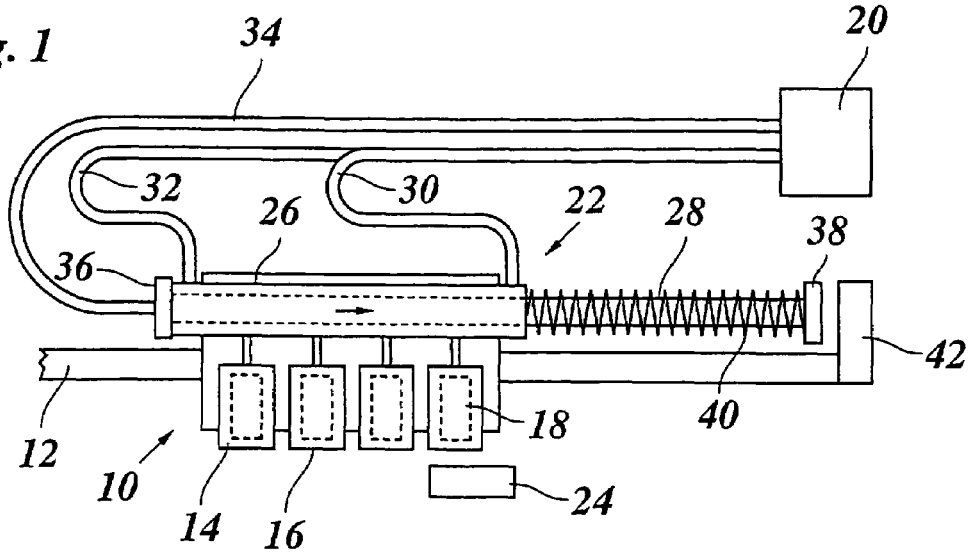
FIG. 1 is a schematic view of the cleaning device according to the present invention in a state immediately before a cleaning operation starts.

As is shown in FIG. 1, an ink jet printer to which the present invention is applicable includes a carriage 10 that is movable, for example, linearly along a guide rail 12 so as to scan a sheet of recording paper. The drawing shows only an end portion of the guide rail 12 outside of the area of the recording paper, so that the recording paper is not visible.

A number of printheads 14, four in this example, are mounted side by side on the carriage 10 and have nozzle faces 16 arranged in a common plane and facing downward in the drawing so as to oppose the recording paper when the carriage 10 scans the paper. Each printhead 14 further has an ink reservoir 18, and the ink reservoirs of the different printheads 14 contain liquid inks of different colors.

The part of the printer that has been shown in FIG. 1 accommodates a cleaning device for cleaning the nozzles in the nozzle faces 16 of the printheads 14 by flushing the nozzles with liquid ink from the ink containers 18. In order to cause the ink to flow out of the nozzles of the printhead, the cleaning device utilizes a pressure source 20 and a distributor valve 22 serving as a valve mechanism for supplying compressed air from the pressure source 20 to the individual ink reservoirs 18, so that the ink will be forced out through the nozzles. The ink that has been jetted out of the nozzles in this way is captured and collected in a gutter 24 which is arranged to face the nozzle face 16 of the printhead that is currently being cleaned. Optionally, the gutter 24 may be combined with a wiper assembly for wiping off remnants of ink from the nozzle faces 16 while the carriage 10 moves past the gutter.

The distributor valve 22 includes an outer tube serving as a valve housing 26 and an inner tube serving as a piston 28 that is slidably accommodated in the valve housing. Both, the valve housing 26 and the piston 28 are connected to the pressure source 20 through flexible tubes 30, 32 and 34, respectively, which have a sufficient length and flexibility to follow the path of travel of the carriage 10 along the guide rail 12. Through the tubes 30, 32 that are connected to the valve housing 26, the pressure source 20 supplies a slight subatmospheric pressure in the order to magnitude of about −1000 Pa, for example. This pressure is normally maintained in the ink reservoirs 18 of the printheads 14 when the printheads are operating or at idle, in order to prevent the ink from leaking out of the nozzles. The tube 34 is connected to one end of the piston 28 and supplies a pulse of positive air pressure, e.g. in the order of 10 kPa, individually and successively to the ink reservoirs 18 of the various printheads 14 at appropriate timings so as to flush the nozzles of each printhead when this printhead moves past the gutter 24.

The supply of air to the ink reservoirs 18 of the individual printheads 14 is controlled by the movement of the piston 28 relative to the valve housing 26, and this movement is controlled by the movement of the carriage 10 relative to the guide rail 12.

Figure 2:
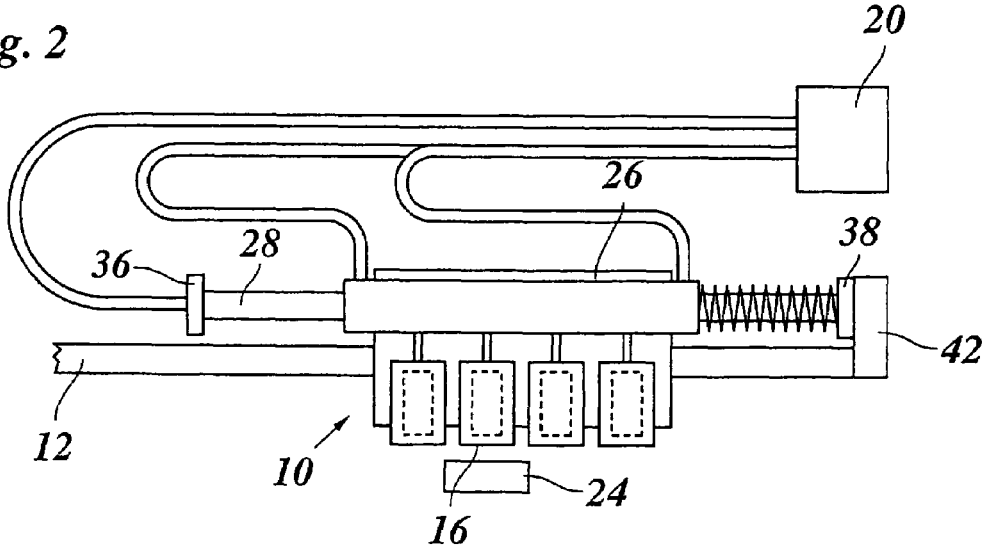
FIG. 2 is a schematic view similar to FIG. 1 but showing a state in which a single printhead is being cleaned.

As is shown in FIG. 1, the piston 28 projects beyond the ends of the valve housing 26 on both sides, and stops 36, 38 are provided on both ends of the piston. In the condition shown in FIG. 1, the carriage 10 is just approaching the cleaning device in the direction of the arrow, and the piston 28 is held in a rest position in which the stop 36 engages the left end of the valve housing 26. The piston is held in this rest position by a compression spring 40 that biases the opposite end of the piston 28 away from the valve housing 26. The stop 38 at this end of the piston just about reaches an abutment 42 that is held stationary relative to the guide rail 12. When the carriage 10 moves further to the right in FIG. 1, the stop 38 engages the abutment 42, and the piston 28 is pushed through the valve housing 26. This is illustrated in FIG. 2, where the carriage 10 has been moved further to a position in which the nozzle face 16 of the third printhead faces the gutter 24.

Figure 3:
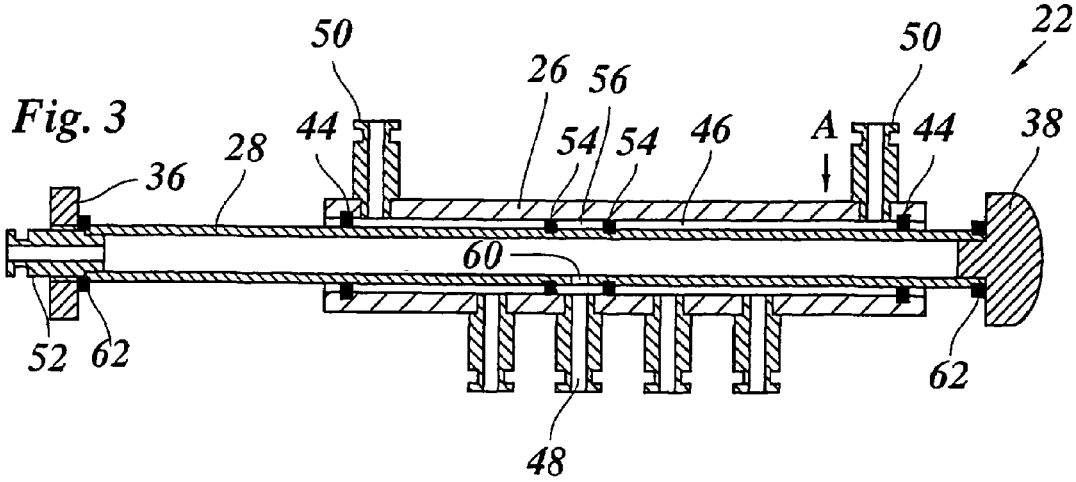
FIG. 3 is a schematic, longitudinal section through a valve mechanism of the device according to the present invention.

The internal construction of the distributor valve 22 is shown in FIG. 3. Here, the tubular valve housing 26 is shown to have seal rings 44 at both ends, by which the piston 28 is slidingly guided in the valve housing, so that an annular first pressure chamber 46 is formed between the piston 28 and the internal wall of the valve housing 26 and is closed-off at both ends by the seal rings 44. This first pressure chamber 46 has four outlet ports 48 that are axially aligned in the circumferential wall of the valve housing 26 and are shaped as connectors to be respectively connected to one of the ink reservoirs 18 of the printheads 14. Further, the valve housing 26 has two connectors 50 which are arranged near the opposite ends of the valve housing and serve to connect the low-pressure tubes 30 and 32 to the first pressure chamber 46.

The tubular piston 28 is closed by the stop 38 at one end, whereas the other end forms a connector 52 for the high-pressure tube 34. In the axial center of the piston 28, two seal rings 54 are fixed on the outer surface of the piston. Together, these seal rings 54 form a seal which separates an annular second pressure chamber 56 from the first pressure chamber 46. The seal rings 54 also divide the first pressure chamber 46 into two separate compartments, which is the reason for providing two connectors 50, one for each compartment.

An inlet port 60 of the second pressure chamber 56 is formed in the peripheral wall of the piston 28 in a section between the two seal rings 54. In the condition shown in FIG. 3, the inlet port 60 and the second pressure chamber 56 are aligned with the third outlet port 48, so that the high pressure supplied via the tube 34 will be forwarded through the interior of the piston 28, the inlet port 60, the second pressure chamber 56 and the outlet port 48 into the ink reservoir 18 of the third printhead. This corresponds to the condition shown in FIG. 2, where the third printhead faces the gutter 24.

In the condition shown in FIG. 1, when the piston 28 is in its rest position, the inlet port 60 would be in a position near the right connector 50, and in this position the second pressure chamber 56 is connected to none of the outlet ports 48 nor to the connector 50. In FIG. 3, this position of the inlet port 60 is indicated by an arrow A.

When the piston 28 is in the rest position, and the carriage 10 approaches the abutment 42, the second pressure chamber 56 moves past the outlet ports 48, so that the high pressure is applied successively to the ink reservoirs of the printheads 14 in synchronism with the movement of the printheads past the gutter 24. A second series of cleaning steps will be performed in reserve order when the carriage moves away from the abutment 42 in the reverse stroke. Thus, a two-step cleaning process will automatically be performed separately for each of the printheads 14 whenever the carriage 10 is moved to the end portion of the guide rail 12 where the cleaning device is located.

In the example shown in FIG. 3, the piston 28 has additional seal rings 62 at both ends. These seal rings 62 will enter into the valve housing 26 and engage the seal rings 44 of the valve housing when the piston reaches one of its two end positions. It should be noted that the seal rings 54 delimiting the second pressure chamber 56 are movable with the piston 28, whereas the seal rings 44 are stationary relative to the valve housing 26. In the process of assembly, the seal rings 44 which are arranged close to the ends of the valve housing 26 may be inserted after the piston 28 carrying the seal rings 54 has been inserted into the valve housing but before the stops 36, 38 are mounted on the piston.

It will occur to a person skilled in the art that the embodiment described above may be modified in various ways. For example, the distributor valve 22 may be arranged stationary relative to the guide rail 12 and the pressure source 20, if the printheads 14 are connected to the valve housing 26 through respective flexible tubes. The abutment 42 would then be replaced by an abutment arranged appropriately on the carriage 10. As another alternative, the piston 28 of the distributor valve may be driven by any suitable drive mechanism such as a rack-and-pinion assembly or the like which itself is driven synchronously with the movement of the carriage.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A nozzle cleaning device for an ink jet printer containing a plurality of ink reservoirs, the cleaning device including a pressure source and a valve mechanism for selectively coupling the pressure source to the ink reservoirs, wherein the valve mechanism comprises a valve housing; and a piston movable within the valve housing and defining therewith a first pressure chamber and a second pressure chamber, said first and second pressure chamber being connected to the pressure source such that during idle conditions, the pressure source is in communication with the ink reservoirs through said first pressure chamber, and during cleaning conditions and through the movement of the piston, the pressure source is in selective communication with individual ink reservoirs through said second pressure chamber.

2. The nozzle cleaning device of claim 1, wherein means are provided for maintaining the first pressure chamber at subatmospheric pressure.

3. The nozzle cleaning device of claim 1, wherein each ink reservoir is mounted in or on a movable printhead, wherein The movement of the piston is coupled with the movement of the printheads.

4. The nozzle cleaning device of claim 3, wherein a gutter is arranged to collect ink that is jetted out from the nozzles in the cleaning operation, wherein the movement of the piston relative to the valve housing is synchronized with the movement of the printheads relative to the gutter such that the ink reservoir of a printhead communicates with the pressure source only when this printhead is facing the gutter.

5. The nozzle cleaning device of claim 4, wherein the first pressure chamber and second pressure chamber are annular chambers disposed between the piston and the valve housing and further defined by sealing rings.

6. The nozzle cleaning device of claim 5, wherein the first pressure chamber is provided with at least one connection which communicates with the pressure source and a plurality of outlet ports each of which is connected to one of the ink reservoirs.

7. The nozzle cleaning device of claim 6, wherein the second pressure chamber is provided with an inlet port which provides communication between an individual ink reservoir and the pressure source through the piston.

8. The nozzle cleaning device of claim 6, wherein the valve housing is provided with two connectors that are both connected to the pressure source and are arranged at opposite ends of the valve housing and axially offset from the outlet ports.

9. The nozzle cleaning device of claim 8, wherein the pressure source is stationary relative to the gutter and is connected to the valve mechanism through flexible tubes.

10. The nozzle cleaning device of claim 9 wherein the flexible tubes are connected to the connectors and to the piston.

11. The nozzle cleaning device of claim 4, wherein the valve housing is arranged in parallel with the direction of relative movement of the printheads and the gutter, and the piston which projects out of the valve housing at both ends thereof is elastically biased into an end position relative to the valve housing and is adapted to cooperate with an abutment so as to be pushed through the valve housing in accordance with the relative movement of the printheads and the gutter.

12. The nozzle cleaning device of claim 4, wherein the printheads and the valve mechanism are mounted on a common cartridge that is movable relative to the gutter.

13. The nozzle cleaning device of claim 3 wherein the valve housing has a tubular shape and the piston is movable axially through the valve housing.

* * * * *